US008175508B2

(12) United States Patent
Kageyama

(10) Patent No.: US 8,175,508 B2
(45) Date of Patent: May 8, 2012

(54) PLANAR HEAT GENERATING ELEMENT, FIXING DEVICE INCLUDING THE SAME, AND IMAGE FORMING APPARATUS INCLUDING THE SAME

(75) Inventor: Hiroyuki Kageyama, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 476 days.

(21) Appl. No.: 12/425,449

(22) Filed: Apr. 17, 2009

(65) Prior Publication Data

US 2009/0263171 A1 Oct. 22, 2009

(30) Foreign Application Priority Data

Apr. 18, 2008 (JP) ..... 2008-109603

(51) Int. Cl.
*G03G 15/20* (2006.01)

(52) U.S. Cl. ..... 399/329; 399/334

(58) Field of Classification Search ..... 399/329
See application file for complete search history.

(56) References Cited

U.S. PATENT DOCUMENTS

| | | | | |
|---|---|---|---|---|
| 4,075,456 | A * | 2/1978 | Sakamaki et al. | 219/216 |
| 6,243,559 | B1 | 6/2001 | Kurotaka et al. | |
| 6,847,019 | B2 * | 1/2005 | Yokozeki et al. | 219/619 |
| 7,035,581 | B2 * | 4/2006 | Cho et al. | 399/329 |
| 2002/0076243 | A1 * | 6/2002 | Nakafuji et al. | 399/329 |
| 2003/0183610 | A1 * | 10/2003 | Okabayashi et al. | 219/216 |
| 2009/0136273 | A1 * | 5/2009 | Kobayashi | 399/329 |

FOREIGN PATENT DOCUMENTS

| | | | |
|---|---|---|---|
| JP | 10-307496 | | 11/1998 |
| JP | 11-282297 | | 10/1999 |
| JP | 2000-195650 | | 7/2000 |
| JP | 2001126847 | A * | 5/2001 |
| JP | 2002-333788 | | 11/2002 |
| JP | 2006-215056 | | 8/2006 |
| JP | 2006215056 | A * | 8/2006 |
| JP | 2007-109640 | | 4/2007 |

OTHER PUBLICATIONS

Machine translation of JPO Notification of Reasons for Refusal in appl. No. 2008-109603 dated Apr. 2, 2010.*
Machine translation of JPO Decision of Refusal in appl. No. 2008-109603 dated Jul. 12, 2010.*
Machine translation of JP 2001126847 A.*

* cited by examiner

*Primary Examiner* — David Gray
*Assistant Examiner* — David Bolduc
(74) *Attorney, Agent, or Firm* — Renner, Otto, Boisselle & Sklar, LLP

(57) ABSTRACT

A planar heat generating element includes an insulating layer and a resistance heat generator formed on one surface in a thickness direction of the insulating layer, for generating heat under a passage of electric current therethrough, the resistance heat generator constituting a plane of certain configuration as a whole and forming a heat generating pattern. The resistance heat generator includes a plurality of linear portions formed on one surface of the insulating layer that extend transversely with respect to a longitudinal direction of the insulating layer, the linear portions being arranged side by side substantially in parallel to each other; and a low-volume resistivity portion formed on the one surface so as to extend in the longitudinal direction of the insulating layer, and connecting the adjacent linear portions at their extending directionwise ends to form a single line composed of the adjacent linear portions and the low-volume resistivity portion.

9 Claims, 9 Drawing Sheets

C1 = C2 < C3 = C4

C1 < C2 < C3 = C4

C1 < C2 < C3 < C4

PLANAR HEAT GENERATING ELEMENT, FIXING DEVICE INCLUDING THE SAME, AND IMAGE FORMING APPARATUS INCLUDING THE SAME

CROSS-REFERENCE TO RELATED APPLICATION

This application claims priority to Japanese Patent Application No. 2008-109603, which was filed on Apr. 18, 2008, the contents of which are incorporated herein by reference in its entirety.

BACKGROUND OF THE INVENTION

1. Field of the Invention

The present invention relates to a planar heat generating element having a resistance heat generator for generating heat upon a passage of electric current therethrough, a fixing device including the planar heat generating element, and an image forming apparatus including the fixing device.

2. Description of the Related Art

As a fixing device for use in an electrophotographic image forming apparatus such as a copying machine and a printer, a fixing device of heat-roller fixing type has been in wide use. The fixing device of heat-roller fixing type includes a pair of rollers, a fixing roller and a pressure roller, that are brought into contact with each other under pressure. By means of a heating section composed for example of a halogen lamp, which is placed in each of or one of the pair of rollers interiorly thereof, the pair of rollers are heated to a predetermined fixing temperature. With the pair of rollers kept in a heated state, such as a recording paper sheet, which is a recording medium having formed thereon an unfixed toner image, is fed to a region where the pair of rollers make pressure-contact with each other, namely a fixing nip region. Upon the recording paper sheet passing through a pressure contact portion, the toner image is fixed into place under application of heat and pressure.

Incidentally, a fixing device for use in a color image forming apparatus generally employs an elastic roller constructed by forming an elastic layer made for example of silicone rubber on a surface layer of the fixing roller. By designing the fixing roller as an elastic roller, it is possible for the surface of the fixing roller to become elastically deformed so as to conform to irregularities of the unfixed toner image, wherefore the fixing roller makes contact with the toner image so as to cover the surface of the toner image. This makes it possible to perform satisfactory thermal fixation on the unfixed color toner image that is larger in toner adherent amount than a monochromatic toner image. Moreover, by virtue of a deflection-releasing effect exerted by the elastic layer in the fixing nip region, it is possible to provide enhanced releasability for a color toner that is more susceptible to occurrence of offset than a monochromatic toner. Further, since the fixing nip region is convexly curved in a radially-outward direction so as to define a so-called reverse nip configuration, it is possible to attain higher paper-stripping capability. That is, a paper stripping action can be produced without using a stripping portion such as a stripping pawl (self-stripping action), wherefore image imperfection caused by the provision of the stripping portion can be eliminated.

Incidentally, in such a fixing device provided in a color image forming apparatus, it is necessary to make a nip width of a fixing nip section wide in order to correspond to increase in speed. One available method of increasing the fixing nip width is to increase the thickness of the elastic layer of the fixing roller and the diameter of the fixing roller. However, in a fixing roller having an elastic layer, the elastic layer can not sufficiently conduct heat, thus, in a case where a heating section is provided inside the fixing roller, there is a problem that a temperature of the fixing roller is not followed when a process speed is increased. On the other hand, when a diameter of the fixing roller is increased, there is a problem that it takes longer time to warm up or power consumption is increased.

As a fixing device provided in a color image forming apparatus to solve such problems, Japanese Unexamined Patent Publication JP-A 10-307496 (1998) discloses a fixing device of belt fixing type that is configured so that a fixing belt is supported around a fixing roller and a heating roller and the fixing roller and a pressure roller are brought into pressure-contact with each other with the fixing belt interposed therebetween. In the fixing device of belt fixing type, since the fixing belt with small heat capacity is heated, it takes short time to warm up and it is not necessary to incorporate a heat source such as a halogen lamp in the fixing roller, thus making it possible to provide a thick elastic layer with low hardness made of sponge rubber and the like and to secure a wide nip width.

Furthermore, JP-A 2002-333788 discloses a fixing device of planar heat generating belt fixing type with a heating section as a planar heat generating element. In the fixing device of planar heat generating belt fixing type, when heat capacity of the heating section is reduced, the planar heat generating element as the heating section directly generates heat at the same time, thus a thermal response speed is also enhanced compared to a system in which a heating roller is heated indirectly using a halogen lamp or the like and it is possible to attain further shortening of a time for warm up and more energy saving.

However, in a fixing system using a resistance heat generating element as the planar heat generating element, a member with small heat capacity is used as a substrate so that a surface temperature is determined by a balance between transmitted heat and radiated heat, thus heat radiation volume from both ends of the roller is increased when heat is generated. Accordingly, the temperature of the both ends of the planar heat generating element is lower than that of its center part and it is difficult to obtain uniform temperature distribution over the all areas in a width direction. As a result, when such a fixing device is applied to an image forming apparatus such as a copier and a printer, variance is generated in a toner fixing temperature and the printing quality is deteriorated.

Japanese Unexamined Patent Publication JP-A 2006-215056 discloses a fixing device devised to solve such a problem. FIG. 9 is a view showing the structure of a planar heat generating element 200 provided in the fixing device according to the related art. The planar heat generating element 200 has a heat generating pattern 201 formed of a heat generating line 202 that constitutes a certain plane as a whole. The heat generating pattern 201 includes a plurality of linear portions 202*a* which are arranged side by side substantially in parallel with one another, of which each is inclined at a predetermined angle θ with respect to an axial direction X of a fixing belt. The heat generating pattern 201 is formed on a surface of an insulating layer 203. The heat generating line 202 has its both ends connected via a control section 205 to a power source 204. In this structure, energization control is exercised on the basis of temperatures detected by a non-illustrated temperature sensor.

In the planar heat generating element 200 thus constructed, formation of the plurality of heat generating patterns 201 makes it possible to obtain a plurality of heat generating regions. By actuating the power source 204 so as to apply a voltage to the plurality of heat generating regions in a selective manner, it is possible to render the distribution of temperatures over the areas of boundaries among the heat generating regions more even, and thereby heat the fixing belt to a desired temperature with a smoothed temperature distribution.

The planar heat generating element 200 is, at the insulating layer 203, fixedly disposed on the back surface of a substrate disposed in contact with the fixing belt. However, the heat generating line 202 includes a bend portion 202*b*. When the heat generating line 202 having the bend portion 202*b* receives application of a voltage from the power source 204 and thereby electric current of high magnitude is passed therethrough, then the electric current flows intensively through the bend portion 202*b* of the heat generating line 202 interiorly thereof. Therefore, the bend portion 202*b* liberates heat excessively, with the result that that part of the heat generating line 202 which constitutes the bend portion 202*b* or that part of the insulating layer 203 which faces the bend portion 202*b* may be caused to peel off from the substrate. In consequence, since the heat generated from the peeled heat generating line 202 cannot be transmitted to the heat generating substrate, it becomes impossible to apply heat to the fixing belt in such a manner as to render the temperature distribution on the surface thereof uniform. Furthermore, the excessive heat generation from the bend portion 202*b* leads to the possibility that the heat generating line 202 suffers from a fracture or the insulating layer 203 catches fire.

Particularly, in a case where the heat generating line 202 and the insulating layer 203, as well as the insulating layer 203 and the substrate, are not kept in intimate contact with each other uniformly and sufficiently, or in a case where the planar heat generating element 200 needs to be disposed securely on a substrate having a curved surface, a stress is concentrated excessively on the bend portion 202*b*. As a result, the heat generating line 202 is apt to peel due to the resultant excessive heat generation.

SUMMARY OF THE INVENTION

Accordingly, an object of the invention is to provide a planar heat generating element having a resistance heat generator for generating heat upon a passage of electric current therethrough, in which occurrence of localized excessive heat generation in the resistance heat generator can be prevented. Another object of the invention is to provide a fixing device including the planar heat generating element. Still another object of the invention is to provide an image forming apparatus including the fixing device.

The invention provides a planar heat generating element for use in a fixing device for fixing a toner image borne on a recording medium onto the recording medium under application of heat and pressure, the planar heat generating element comprising:

an insulating layer;

a resistance heat generator formed on one surface in a thickness direction of the insulating layer, for generating heat upon a passage of electric current therethrough, the resistance heat generator constituting a plane of certain configuration as a whole and forming a heat generating pattern, the resistance heat generator comprising:

a plurality of linear portions formed on one surface of the insulating layer so as to extend transversely with respect to a longitudinal of the insulating layer, the plurality of linear portions being arranged side by side substantially in parallel with one another; and a low-volume resistivity portion formed on the one surface of the insulating layer so as to extend in the longitudinal direction of the insulating layer, and connecting the adjacent linear portions at their extending direction-wise ends to form a single line composed of the adjacent linear portions and the low-volume resistivity portion, the low-volume resistivity portion being made of a material which is lower in volume resistivity than a material for forming the linear portion.

According to the invention, the planar heat generating element is designed for use in a fixing device for fixing a toner image borne on a recording medium onto the recording medium under application of heat and pressure. The planar heat generating element comprises an insulating layer and a resistance heat generator formed on one surface in the thickness direction of the insulating layer, for generating heat upon the passage of electric current therethrough, the resistance heat generator constituting a plane of certain configuration as a whole and forming a heat generating pattern. In this construction, the resistance heat generator comprises: a plurality of linear portions formed on one surface of the insulating layer so as to extend transversely with respect to the longitudinal direction of the insulating layer, the plurality of linear portions being arranged side by side substantially in parallel with one another; and a low-volume resistivity portion formed on one surface of the insulating layer so as to extend in the longitudinal direction of the insulating layer, and connecting the adjacent linear portions at their extending direction-wise ends to form a single line composed of the adjacent linear portions and the low-volume resistivity portion. That is, in such a planar heat generating element, the low-volume resistivity portion corresponds to the bend portion of the resistance heat generator.

While the linear portion is designed to generate heat sufficiently, the low-volume resistivity portion corresponding to the bend portion is made of a material having a volume resistivity which is lower than the volume resistivity of the material for forming the linear portion. This helps prevent a localized intensive flow of electric current through the bend portion. Accordingly, the resistance heat generator can be protected from occurrence of localized excessive heat generation, wherefore it is possible to avoid that the resistance heat generator is caused to peel off from the insulating layer or suffers from a fracture.

Moreover, in the invention, it is preferable that a region in which the low-volume resistivity portion is formed includes a corner where the resistance heat generator bends.

According to the invention, the region in which the low-volume resistivity portion is formed includes the corner where the resistance heat generator bends. This makes it possible to prevent a localized intensive flow of electric current through the bend portion and thereby protect the resistance heat generator from localized excessive heat generation. Accordingly, it is possible to avoid that the resistance heat generator is caused to peel off from the insulating layer or suffers from a fracture.

Moreover, in the invention, it is preferable that the heat generating pattern is formed so as to be divided into plural pieces in the longitudinal direction of the insulating layer, and the plural pieces of heat generating pattern can be subjected to the passage of electric current independently of each other.

According to the invention, the heat generating pattern constituted by the resistance heat generator is formed so as to be divided into plural pieces in the longitudinal direction of the insulating layer. The plural pieces of heat generating pattern can be subjected to the passage of electric current independently of each other. In this construction, the heat generation amount in the longitudinal direction of the planar heat generating element can be adjusted by changing the condition of energization. This makes it possible to control the temperature distribution on the surface of the planar heat generating element to assume a desired form.

Moreover, in the invention, it is preferable that an extending direction of the plurality of linear portions is inclined at a predetermined angle with respect to a longitudinal direction of the planar heat generating element.

According to the invention, the extending direction of the plurality of linear portions is inclined at the predetermined angle with respect to the longitudinal direction of the planar heat generating element. In this case, it is possible to prevent a decrease in temperature on that part of the surface of the planar heat generating element on which is formed the low-volume resistivity portion, and thereby render the temperature distribution on the surface of the planar heat generating element uniform.

Moreover, in the invention, it is preferable that intervals among the plurality of linear portions adjacent to one another are set so as to become smaller from the center of the planar heat generating element toward each end thereof within a predetermined region located at each of the longitudinal end portions of the planar heat generating element.

According to the invention, the intervals among the plurality of linear portions adjacent to one another are set so as to become smaller from the center of the planar heat generating element toward each end thereof within a predetermined region located at each of the longitudinal end portions of the planar heat generating element. In so doing the power density within the predetermined region can be increased. This makes it possible to suppress a dissipative heat loss at each of the end portions of the planar heat generating element corresponding to the predetermined regions, and thereby render uniform the temperature distribution in the longitudinal direction of the planar heat generating element. Accordingly, uniformity can be imparted to the fixability of a toner image borne on a recording medium.

Moreover, in the invention, it is preferable that the material used for forming the low-volume resistivity portion is selected from among zinc, gold, copper, and silver.

According to the invention, the material used for forming the low-volume resistivity portion is selected from among zinc, gold, copper, and silver. With the provision of the low-volume resistivity portion made of such a material, it is possible to prevent a localized intensive flow of electric current through the resistance heat generator.

The invention further provides a fixing device comprising:

a fixing member;

a heating member;

an endless fixing belt supported around the fixing member and the heating member with tension; and a pressure member disposed face to face with the fixing member, with the fixing belt interposed therebetween, the heating member heating the fixing belt in contact therewith, the fixing belt and the pressure member constituting a fixing nip region where a toner image borne on a recording medium is fixed into place under application of heat and pressure, the heating member having a heating portion for heating the fixing belt in contact therewith, the heating portion being formed with the above-described planar heat generating element extending in a longitudinal direction of the fixing member.

According to the invention, it is possible to realize the fixing device in which the planar heat generating element is formed in the heating portion of the heating member for heating the fixing belt in contact therewith.

Moreover, in the invention, it is preferable that the heading portion of the heating member has a substrate made of a material with a high thermal conductivity, and the planar heat generating element formed on one surface of the substrate, and the heating portion has a coat layer formed on a surface coming into contact with the fixing belt to allow a reduction in the force of friction between the heating member and the fixing belt.

According to the invention, the heating portion of the heating member has the substrate made of a material with a high thermal conductivity and the planar heat generating element formed on the one surface of the substrate, and the heating portion has a coat layer formed on the surface coming into contact with the fixing belt to allow a reduction in the force of friction between the heating member and the fixing belt. In this way, the force of friction between the heating member and the fixing belt can be reduced. This makes it possible to protect the fixing belt from abrasion and thereby impart high durability to the fixing belt.

Moreover, in the invention, it is preferable that the coat layer is formed of at least one of a PTFE resin and a PFA resin each of which contains fluorine.

According to the invention, by using a material made of at least one of a PTFE resin and a PFA resin each of which contains fluorine, it is possible to realize a coat layer for allowing a reduction in the force of friction between the heating member and the fixing belt.

Further, the invention also provides an image forming apparatus including the above-described fixing device.

The invention provides an image forming apparatus which is realized with use of the fixing device.

BRIEF DESCRIPTION OF DRAWINGS

Other and further objects, features, and advantages of the invention will be more explicit from the following detailed description taken with reference to the drawings wherein.

DETAILED DESCRIPTION

Figure 1:
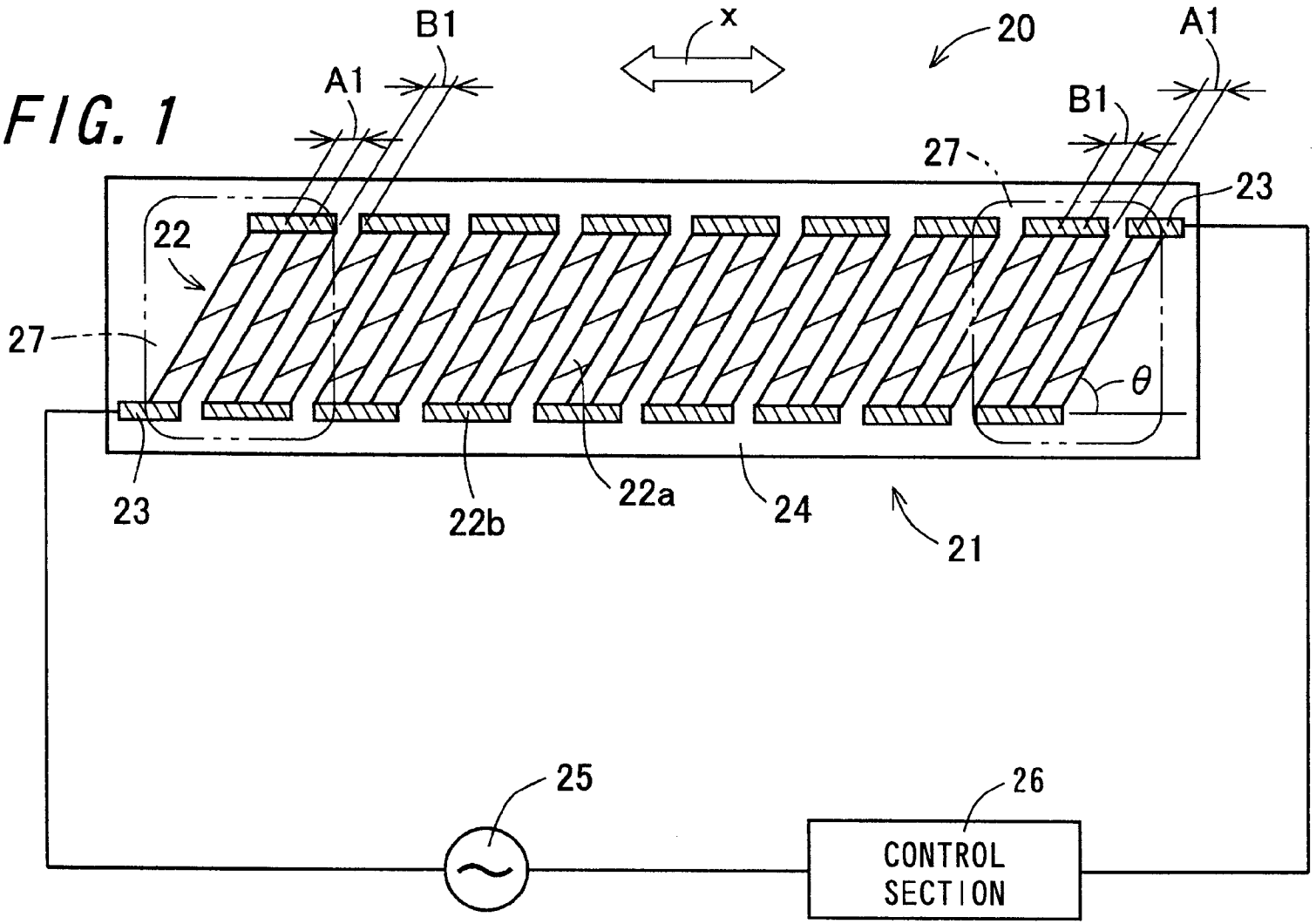
FIG. 1 is a view showing the structure of a planar heat generating element in accordance with a first embodiment of the invention.

Now referring to the drawings, preferred embodiments of the invention will be described in detail.

Figure 2A:
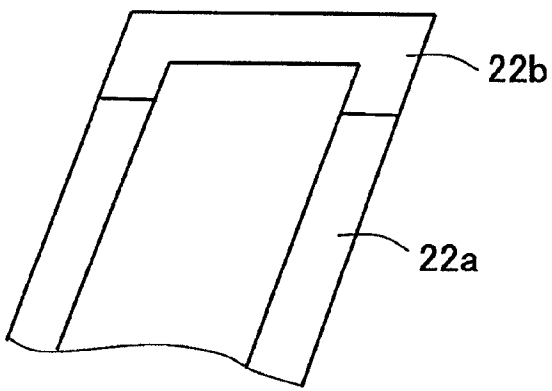
FIGS. 2A to 2C are views indicating where a low-volume resistivity portion is formed in a resistance heat generator.
Figure 2B:
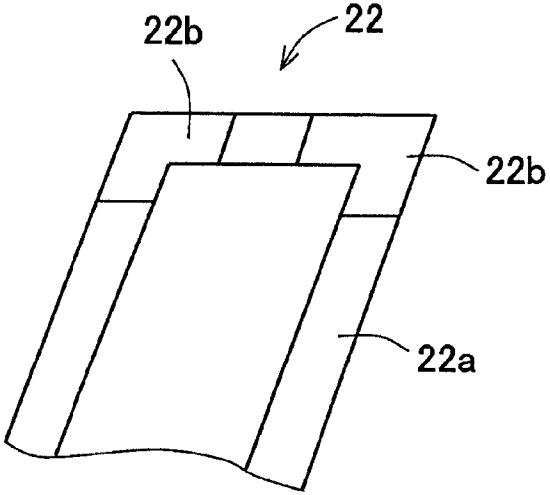
Figure 2C:
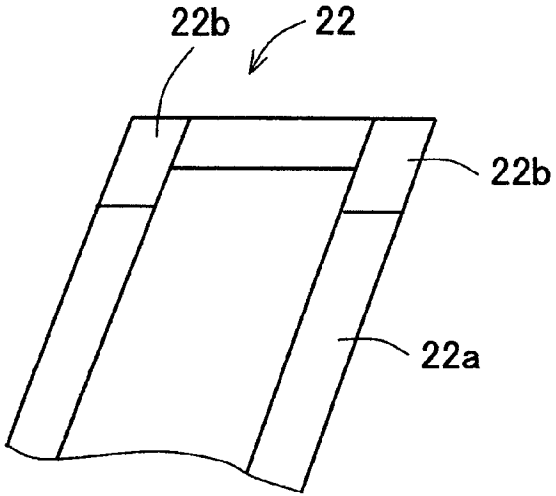

FIG. 1 is a view showing the structure of a planar heat generating element 20 in accordance with a first embodiment of the invention. Moreover, FIGS. 2A to 2C are views indicating where a low-volume resistivity portion 22*b* is formed in a resistance heat generator 22. The planar heat generating element 20 roughly includes the resistance heat generator 22 and an insulating layer 24. Upon application of a voltage to the resistance heat generator 22, electric current is passed therethrough, which results in Joule heating. The insulating layer 24 is a layer made of, for example, a ceramic material such as alumina or a heat-resistant polymer material such as a polyimide resin. The insulating layer 24 acts as a base layer of the planar heat generating element 20 on which is formed the resistance heat generator 22.

The resistance heat generator 22, which constitutes a plane of certain shape as a whole thereby to assume a heat generating pattern 21, is formed on one surface of the insulating layer 24 in a thickness direction thereof. The heat generating pattern 21 defined in the resistance heat generator 22 serves as a heat generating region of the planar heat generating element 20. The heat generating pattern 21 includes a linear portion 22*a* and a low-volume resistivity portion 22*b*.

There are provided a plurality of linear portions 22*a* formed on one surface of the insulating layer 24 so as to extend transversely with respect to a longitudinal direction of the insulating layer 24 (a longitudinal direction of the planar heat generating element 20). The linear portions 22*a* are arranged side by side substantially in parallel with one another. Moreover, the linear portion 22*a* is made of a material composed predominantly of nickel and chromium having a volume resistivity of approximately $107.3\times10^{-8}$ Ωcm.

The low-volume resistivity portion 22*b* is formed on one surface of the insulating layer 24 so as to extend in the longitudinal direction of the planar heat generating element 20, and connects the adjacent linear portions 22*a* at their extending direction-wise ends to form a single line composed of the adjacent linear portions 22*a* and the low-volume resistivity portion 22*b*. That is, in the resistance heat generator 22 constituting the heat generating pattern 21 according to the invention, the low-volume resistivity portion 22*b* corresponds to the bend portion of the resistance heat generator 22. The low-volume resistivity portion 22*b* is made of a material having a volume resistivity which is lower than or equal to one-tenth part of the volume resistivity of the material for forming the linear portion 22*a*.

Examples of materials used for forming the low-volume resistivity portion 22*b* include zinc whose volume resistivity is approximately $5.9\times10^{-8}$ Ωcm, gold whose volume resistivity is approximately $2.05\times10^{-8}$ Ωcm, copper whose volume resistivity is approximately $1.55\times10^{-8}$ Ωcm, silver whose volume resistivity is approximately $1.47\times10^{-8}$ Ωcm, and so forth. In particular, the use of silver or copper is desirable because of its low volume resistivity and inexpensiveness.

Moreover, upon the passage of electric current through the resistance heat generator 22, heat generation takes place. At this time, since the low-volume resistivity portion 22*b* is made of a material having a low volume resistivity, a heat generation amount thereof is smaller than that of the linear portion 22*a*. Therefore, when the proportion in area of the low-volume resistivity portion 22*b* is unduly large, unevenness will show up in the distribution of temperatures on the surface of the planar heat generating element 20. In view of the foregoing, in the resistance heat generator 22, the ratio in area of all the low-volume resistivity portions 22*b* to all the linear portions 22*a* is so determined that the temperature distribution on the surface of the planar heat generating element 20 can be made uniform.

Note that, in the resistance heat generator 22, a region in which is formed the low-volume resistivity portion 22*b*, which corresponds to the bend portion, may be given any configuration so long as it includes a corner where the resistance heat generator 22 bends. More specifically, as shown in FIG. 2A, the region in which the low-volume resistivity portion 22*b* is formed may be defined by that part of the resistance heat generator 22 which includes the corners of its bend and a portion extending between the corners in the longitudinal direction of the planar heat generating element 20. Moreover, as shown in FIG. 2B, the region in which the low-volume resistivity portion 22*b* is formed may be defined by that part of the resistance heat generator 22 which includes one corner of its bend and a portion extending partway from the corner in the longitudinal direction of the planar heat generating element 20, and that part of the resistance heat generator 22 which includes the other corner of its bend and a portion extending partway from the corner in the same direction. Further, as shown in FIG. 2C, the region in which the low-volume resistivity portion 22*b* is formed may be defined only by the corner of a bend in the resistance heat generator 22.

The resistance heat generator 22 constituted by the linear portions 22*a* and the low-volume resistivity portions 22*b* has its opposite ends connected respectively to a power feeding terminal portion 23 formed at each of the lengthwise end portions of the planar heat generating element 20. Upon application of a voltage from a power source 25 to the power feeding terminal portions 23, electric current is passed through the resistance heat generator 22, whereby heat is generated in the resistance heat generator 22 with a positive resistance temperature characteristic. In the present embodiment, the resistance heat generator 22 is designed to liberate heat energy of approximately 1000 W upon application of AC voltage of 100 V to the power feeding terminal portions 23.

When the resistance heat generator includes a linear portion and a bend portion that are made of materials having the same volume resistivity, upon the passage of electric current through the resistance heat generator, the electric current will flow intensively through the bend portion interiorly thereof. In this case, the bend portion liberates heat excessively, with the result that the resistance heat generator may be caused to peel and eventually suffer from a fracture.

In contrast, according to the invention, as has already been described, since the low-volume resistivity portion 22*b* is formed in the bend portion of the resistance heat generator 22, it is possible to prevent a localized intensive flow of electric current through the bend portion and thereby protect the resistance heat generator 22 from localized excessive heat generation. Accordingly, it is possible to avoid that the resistance heat generator 22 is caused to peel off from the insulating layer 24 that will eventually lead to a fracture, as well as to prevent the insulating layer 24 from catching fire or occurrence of like problem.

Moreover, it is preferable that the extending direction of the plurality of linear portions 22*a* is inclined at a predetermined angle θ with respect to the longitudinal direction of the planar heat generating element 20. In the planar heat generating element 20 of the invention, the low-volume resistivity portion 22*b* is formed in the bend portion of the resistance heat generator 22. In this case, the amount of heat generated in the region in which the low-volume resistivity portion 22*b* is formed is small, and the temperature of that part of the surface of the planar heat generating element 20 which conforms to the region in which the low-volume resistivity portion 22*b* is formed may be decreased correspondingly.

For that reason, as described just above, by forming the linear portion 22*a* so as to extend inclined with respect to the longitudinal direction of the planar heat generating element 20, it is possible to compensate for the decrease in temperature in the region in which a heat generation amount is smaller and the heat generation-free region as well, and thereby render uniform the temperature distribution on a fixing belt to which heat is transmitted from the planar heat generating element 20.

Moreover, it is preferable that, in the resistance heat generator 22 formed on the surface of the insulating layer 24, intervals among the plurality of linear portions 22 adjacent to one another are set so as to become smaller from the center of the planar heat generating element 20 toward each end thereof within a predetermined region 27 located at each of the longitudinal end portions of the planar heat generating element 20. At this time, each of the intervals among the plurality of linear portions 22*a* formed within the predetermined region 27 at one longitudinal end portion may differ from or be the same as the corresponding one at the other longitudinal end portion.

In the case of using the planar heat generating element 20 as a member for heating a fixing belt provided in a fixing device which will hereafter be described, the surface temperature of the fixing belt depends upon a balance between heat to be transmitted thereto and heat to be dissipated therefrom, and thus the amount of heat dissipated from the opposite ends of the fixing belt is increased. Therefore, in the planar heat generating element 20, the temperature at each of the end portions is lower than the temperature of the midportion, which makes it difficult to render uniform the temperature distribution throughout the entire region in the longitudinal direction of the planar heat generating element 20.

For that reason, as has already been described, the intervals among the linear portions 22*a* of the resistance heat generator 22 which generates heat by the passage of electric current are set so as to become smaller from the center of the planer heat generating element 20 toward each end thereof within the predetermined region 27 located at each of the longitudinal end portions of the planar heat generating element 20. In this way, the power density within the predetermined region 27 can be increased. This makes it possible to suppress a dissipative heat loss at the end portions of the planar heat generating element 20 corresponding to the predetermined regions 27, and thereby render uniform the temperature distribution in the longitudinal direction of the planar heat generating element 20.

Note that the range of the predetermined region 27 may be determined in consideration of, for example, the width of a recording paper sheet which is fed into the fixing device. To be more specific, the range of the predetermined region 27 is determined in order that the predetermined region 27 of the planar heat generating element 20 disposed face to face with the fixing belt will not be located outwardly of the respective lateral ends of the recording paper sheet in a paper feeding direction. In this way, the recording paper sheet fed in the fixing device is brought into contact with the fixing belt in a state of liberating a sufficiently large amount of heat across the recording paper sheet in the paper feeding direction. Accordingly, the recording paper sheet is allowed to run under the condition where the temperature distribution can be made uniform throughout a region across the recording paper sheet in the paper feeding direction by suppressing a dissipative heat loss at its lateral ends to thereby eliminate the difference in temperature between the midportion and each end portion of the recording paper sheet.

In the present embodiment, the range of the predetermined region 27 is adjusted to include two pieces of the linear portions 22*a* located outermostly at each of the longitudinal end portions of the planar heat generating element 20. An interval A1 between the two linear portions 22*a* lying within the predetermined region 27 is set to 6.4 mm, whereas an interval B1 between another adjacent linear portions 22*a* is set to 7.5 mm.

Moreover, the planar heat generating element 20 may be formed with a coat layer made of a material having a low coefficient of friction so as to cover the resistance heat generator 22 formed on the insulating layer 24. In a case where the planar heat generating element 20, acting as a member for heating the fixing belt provided in the fixing device which will hereafter be described, is disposed in contact with the fixing belt, with the provision of the coat layer on the surface of the planar heat generating element 20, the force of friction between the planar heat generating element 20 and the fixing belt can be reduced. This makes it possible to protect the fixing belt from abrasion and thereby impart high durability to the fixing belt. As the material used for forming the coat layer, at least one of a PTFE (polytetrafluoroethylene) resin and a PFA (copolymer of tetrafluoroethylene and perfluoroalkylvinylether) resin may be adopted.

Note that, as to a method of forming the resistance heat generator 22 including the linear portions 22*a* and the low-volume resistivity portions 22*b* on the insulating layer 24 in the planar heat generating element 20, any of the methods used customarily in the relevant field can be used. The examples thereof include a coating technique, a spraying technique, a printing technique, and a bonding technique.

Figure 3:
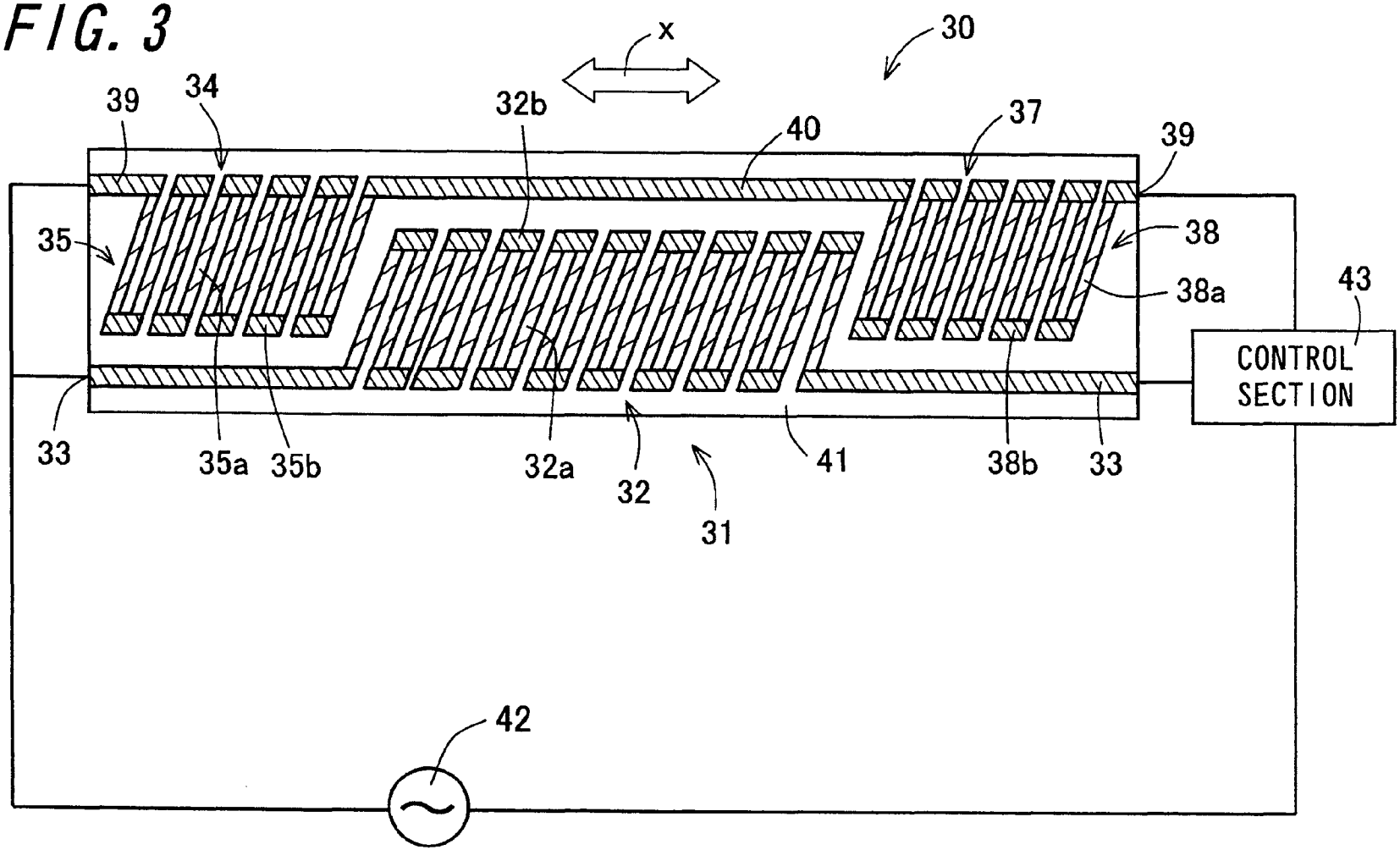
FIG. 3 is a view showing the structure of a planar heat generating element in accordance with a second embodiment of the invention.

FIG. 3 is a view showing the structure of a planar heat generating element 30 in accordance with a second embodiment of the invention. The planar heat generating element 30 includes an insulating layer 41 which is similar in configuration to the insulating layer 24 provided in the foregoing planar heat generating element 20. On one surface of the insulating layer 41 in the thickness direction thereof is formed a heat generating pattern constituting a heat generating region. Moreover, the planar heat generating element 30 is composed of a plurality of heat generating pattern and thus has a plurality of separate heat generating regions. In this embodiment, the planar heat generating element 30 is so designed that there are arranged a heat generating pattern 31 formed in the midportion in a longitudinal direction of the insulating layer 41 and heat generating patterns 34 and 37 formed in the opposite end portions thereof; that is, the planar heat generating element 30 has two separate heat generating regions, namely the one located at both end portions thereof and the one located centrally thereof with respect to the longitudinal direction of the insulating layer 41.

The heat generating patterns 31, 34, and 37 are similar in configuration to the heat generating pattern 21 provided in the foregoing planar heat generating element 20. The heat generating pattern 31 has a resistance heat generator 32 including a linear portion 32*a* and a low-volume resistivity portion 32*b*. The heat generating pattern 34 has a resistance heat generator 35 including a linear portion 35*a* and a low-volume resistivity portion 35*b*. The heat generating pattern 37 has a resistance heat generator 38 including a linear portion 38*a* and a low-volume resistivity portion 38*b*.

The planar heat generating element 30 is controlled as to energization by a control section 43 in such a manner that the heat generating pattern 31 located in the midportion in the longitudinal direction of the planar heat generating element 30 and the heat generating patterns 34 and 37 located at each of the end portions in the longitudinal direction thereof can be subjected to the passage of electric current independently of each other.

To be more specific, the resistance heat generator 32 of the heat generating pattern 31 is, at its opposite ends, connected to a power feeding terminal portion 33 formed at each of the end portions in the longitudinal direction of the planar heat generating element 30. Upon application of a voltage from a power source 42 to the power feeding terminal portions 33 via the control section 43, electric current is passed through the resistance heat generator 32, whereby heat generation takes place. On the other hand, the resistance heat generator 35 of the heat generating pattern 34 and the resistance heat generator 38 of the heat generating pattern 37 are electrically connected to each other at their respective one ends by way of a connecting portion 40 made of the same material as that used for the low-volume resistivity portion. The other ends, respectively, of the resistance heat generator 35 and the resistance heat generator 38 are each connected to a power feeding terminal portion 39 which is different from the power feeding terminal portion 33. Upon application of a voltage from the power source 42 to the power feeding terminal portions 39 via the control section, electric current is passed through the resistance heat generator 35 and the resistance heat generator 38, whereby the resistance heat generator 35 and the resistance heat generator 38 generate heat independently of the resistance heat generator 32.

As described heretofore, in the planar heat generating element 30, it is possible to make adjustment to the heat generation amount in the longitudinal direction of the planar heat generating element 30 by changing the condition of energization, and thereby control the temperature distribution on the surface of the planar heat generating element 30 to assume a desired form.

For example, in the case of using the foregoing planar heat generating element 20 as a member for heating the fixing belt, the heat generating pattern 21 needs to be so designed as to obtain a desired heat generation amount in the longitudinal direction of the planar heat generating element 20 constantly regardless of a difference in size among paper sheets to be fed. In this case, the heat generation amount in the longitudinal direction can be controlled by varying the resistance value in the resistance heat generator 22 through adjustment of its width and length. However, an increase in the width of the resistance heat generator 22 entails restrictions as to the area of the planar heat generating element 20 per se. Furthermore, if the length of the linear portion 22*a* is set unduly short, the proportion in area of the low-volume resistivity portion 22*b* will become so large that unevenness shows up in the temperature distribution on the surface of the planar heat generating element 20.

By way of contrast, in the planar heat generating element 30, the heat generation amount in the longitudinal direction of the planar heat generating element 30 can be adjusted by changing the condition of energization. This makes it possible to control the temperature distribution on the surface of the planar heat generating element 30 to assume a desired form. That is, in the planar heat generating element 30, in order for a toner image formed on a small-sized recording paper sheet to be fixed into place, under the control of the control section 43, the power source 42 is actuated to apply a voltage to the power feeding terminal portion 33 in such a manner that electric current is passed through the heat generating pattern 31 only, which is formed in the midportion in the longitudinal direction of the planar heat generating element 30. On the other hand, in order for a toner image formed on a large-sized recording paper sheet to be fixed into place, the control section 43 exercises energization control in such a manner that electric current is passed through all of the heat generating patterns 31, 34, and 37. In this way, in the planar heat generating element 30, even with the feeding of recording paper sheets of different sizes, the temperature distribution on the surface thereof can be made uniform.

Moreover, also in the planar heat generating element 30, just as with the planar heat generating element 20, it is preferable that the extending direction of the linear portions 32*a*, 35*a*, and 38*a* that constitute the heat generating patterns 31, 34, and 37, respectively, is inclined at a predetermined angle θ with respect to the longitudinal direction of the planar heat generating element 30. In this case, the temperature distribution on the surface of the planar heat generating element 30 can be made uniform.

Further, also in the planar heat generating element 30, just as with the planar heat generating element 20, in each of the heat generating pattern 34 and 37 that are formed at the end portions in the longitudinal direction of the planar heat generating element 30, the intervals among the linear portions are set so as to become smaller from inside toward outside within a predetermined region. In so doing the power density within the predetermined region can be increased. This makes it possible to suppress a dissipative heat loss from the ends of the heat generating patterns 34 and 37 corresponding to the predetermined regions of the planar heat generating element 30, and thereby render uniform the temperature distribution in the longitudinal direction of the planar heat generating element 30.

Figure 4A:
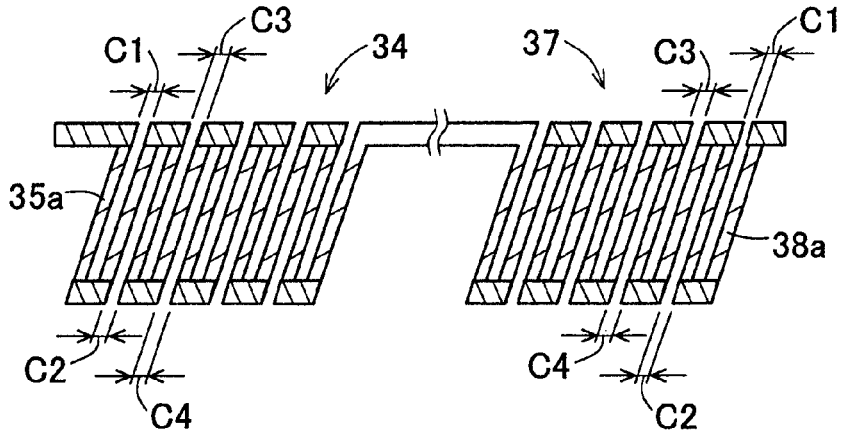
FIGS. 4A to 4C are views showing heat generating patterns located at opposite end portions of the planar heat generating element.
Figure 4B:
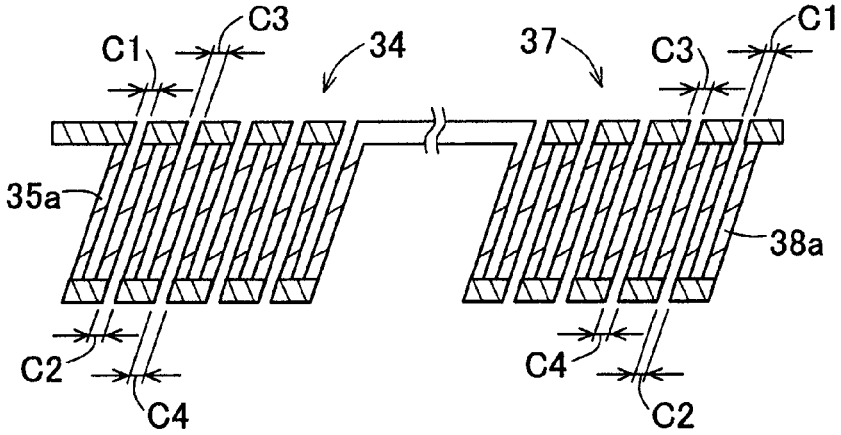
Figure 4C:
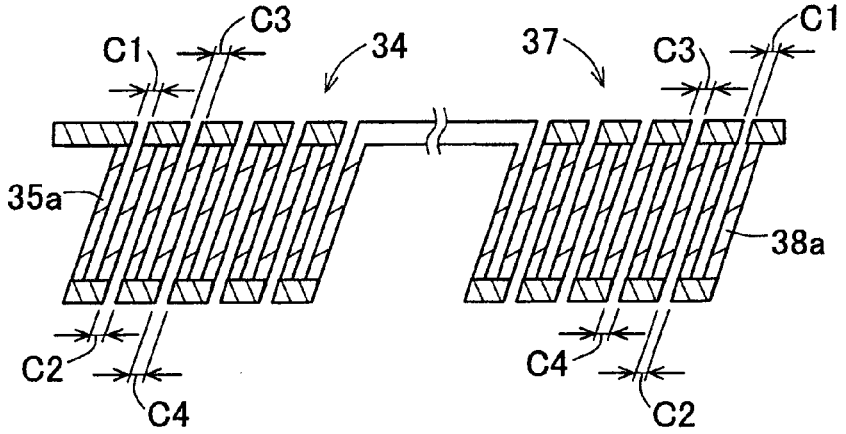

FIGS. 4A to 4C are views showing the heat generating patterns located at the opposite end portions of the planar heat generating element 30. Each of the intervals among a plurality of the linear portions formed within the predetermined region in the heat generating pattern 34 of the planar heat generating element 30 may differ from or be the same as the corresponding one in the heat generating pattern 37.

For example, in a case where the intervals among the linear portions of the resistance heat generator constituting the heat generating patterns 34 and 37, respectively, are defined as, in an outer-to-inner order, an interval C1, an interval C2, an interval C3, and an interval C4, respectively, then the intervals among the linear portions may be so determined as to fulfill the following condition as shown in FIG. 4A: the interval C1=C2<C3=C4, the following condition as shown in FIG. 4B: the interval C1<C2<C3=C4, or the following condition as shown in FIG. 4C: the interval C1<C2<C3<C4.

In the present embodiment, the range of the predetermined region in the heat generating pattern 34 formed at one end portion in the longitudinal direction of the planar heat generating element 30 is adjusted to include two pieces of the linear portions 35*a* located outermostly in the heat generating pattern 34, and the range of the predetermined region in the heat generating pattern 37 formed at the longitudinal other end portion of the planar heat generating element 30 is adjusted to include two pieces of the linear portions 38*a* located outermostly in the heat generating pattern 37. Moreover, the interval between the two linear portions 35*a* lying within the corresponding predetermined region and the interval between the two linear portions 38*a* lying within the corresponding predetermined region are set to be the same (set to 3.0 mm), whereas the interval between another adjacent linear portions 35*a*, as well as the interval between another adjacent linear portions 38*a*, is set to 3.5 mm which is identical with the interval between the adjacent linear portions 32*a* constituting the heat generating pattern 31.

Further, the planar heat generating element 30, just as with the planar heat generating element 20, may also be formed with a coat layer made of a material having a low coefficient of friction so as to cover the heat generating patterns 31, 34, and 37 formed on the insulating layer 41.

Figure 5:
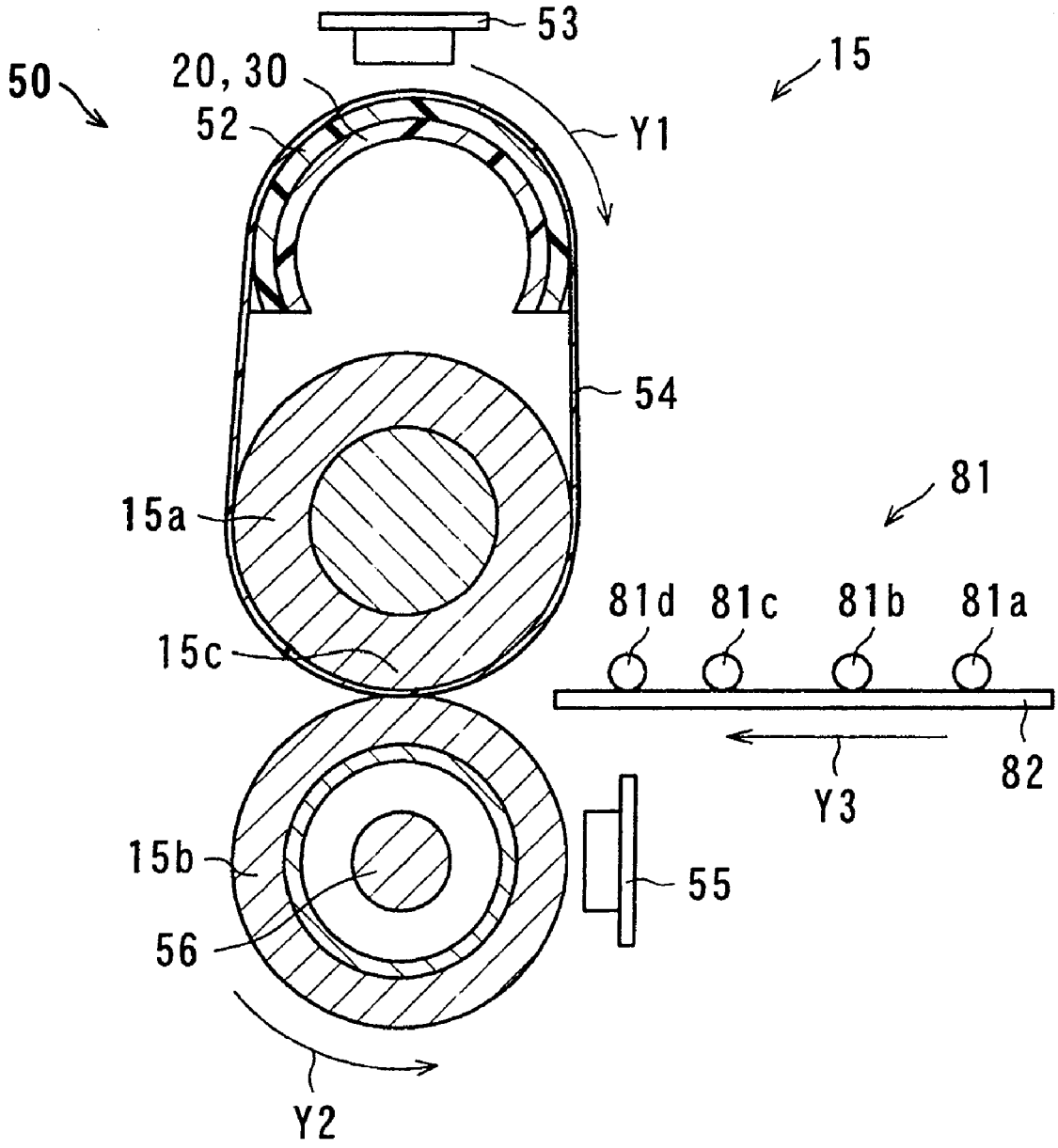
FIG. 5 is a view showing the structure of a fixing device in accordance with a third embodiment of the invention.

FIG. 5 is a view showing the structure of a fixing device 15 in accordance with a third embodiment of the invention. The fixing device 15 includes a fixing roller 15*a*, a pressure roller 15*b*, a fixing belt 54, and a heating member 50. In the fixing device 15, the fixing belt 54 is supported around the fixing roller 15*a* and the heating member 50 with tension, and the pressure roller 15*b* is disposed face to face with the fixing roller 15*a*, with the fixing belt 54 interposed therebetween. Moreover, the fixing roller 15*a* and the heating member 50 are arranged side by side substantially in parallel with each other in an axial direction of the fixing roller 15*a*. With this arrangement, the fixing belt 54 supported around the fixing roller 15*a* and the heating member 50 with tension can be prevented from running windingly during its sliding movement, wherefore the durability of the fixing belt 54 can be maintained at a high level.

The fixing device 15 operates as follows. The heating member 50 heats the fixing belt 54 in contact therewith. At the time when a recording paper sheet 82 employed as a recording medium passes through a fixing nip region 15*c*, which is constituted by the fixing belt 54 and the pressure roller 15*b*, at predetermined fixing speed (in this embodiment, 220 mm/sec) and copying speed, an unfixed toner image 81 borne on the recording paper sheet 82 is fixed into place under application of heat and pressure.

Note that the unfixed toner image 81 is formed of, for example, a developer (toner) such as a non-magnetic one-component type developer (non-magnetic toner), a non-magnetic two-component type developer (non-magnetic toner and carrier), or a magnetic developer (magnetic toner). Moreover, the "fixing speed" corresponds to a so-called process speed, and the "copying speed" corresponds to the number of copies obtained per minute. Further, when the recording paper sheet 82 passes through the fixing nip region 15*c*, the fixing belt 54 abuts against that surface of the recording paper sheet 82 which is opposite from the toner image-bearing surface thereof.

The fixing roller 15*a* is brought into pressure-contact with pressure roller 15*b* with the fixing belt 54 interposed therebetween to thereby form the fixing nip section 15*c*, and at the same time, is provided so as to face and be brought into pressure-contact with the pressure roller 15*b* with the fixing belt 54 interposed therebetween and to rotate freely around a rotational axis thereof. The pressure roller 15*b* is driven by rotation of the fixing roller 15*a* and rotates in a rotational direction Y1. The fixing roller 15*a* has a diameter of 30 mm and has a two-layer structure consisting of a core metal and an elastic layer, which are arranged in this order from inside, and as the core metal, for example, a metal such as iron, stainless steel, aluminum, and copper, an alloy thereof, or the like is used. Moreover, for the elastic layer, a rubber material having heat resistance such as silicone rubber and fluorine rubber is suitable. Note that, in this embodiment, a force when the fixing roller 15*a* is brought into pressure-contact with the pressure roller 15*b* with the fixing belt 54 interposed therebetween is about 216 N.

The pressure roller 15*b* is driven for rotation in a rotational direction Y2 around a rotational axis by a not-shown driving motor (driving section) to thereby cause the fixing belt 54 to run. The pressure roller 15*b* has a three-layer structure consisting of a core metal, an elastic layer, and a release layer, which are arranged in this order from inside. As the core metal, for example, a metal such as iron, stainless steel, aluminum, and copper, an alloy thereof, or the like is used. Moreover, suitable for the elastic layer is a rubber material having heat resistance such as silicone rubber and fluorine rubber, and suitable for the release layer is a fluorine resin such as PFA (copolymer of tetrafluoroethylene and perfluoroalkylvinylether) and PTFE (polytetrafluoroethylene). Moreover, disposed inside the pressure roller 15*b* is a heater lamp 56 for heating the pressure roller 15*b*. When a control circuit (not shown) supplies an electric power (electrifies) from a power source circuit (not shown) to the heater lamp 56, the heater lamp 56 emits light and radiates infrared rays. Whereby, an inner circumferential surface of the pressure roller 15*b* absorbs the infrared rays to be heated and the pressure roller 15*b* is entirely heated.

The fixing belt 54 is heated to a predetermined temperature by the heating member 50 and heats the recording paper sheet 82 having the unfixed toner image 81 formed thereon that passes through the fixing nip region 15*c*. The fixing belt 54 is an endless belt having a diameter of 50 mm and is set around the heating member 50 and the fixing roller 15*a* and wound up by the fixing roller 15*a* with a predetermined angle. During rotation of the fixing roller 15*a*, the fixing belt 54 is driven by the fixing roller 15*a* and rotates in the rotational direction Y1. The fixing belt 54 has a three-layer structure consisting of a substrate having a hollow cylindrical shape made of a heat resistant resin such as polyimide or a metal material such as stainless steel and nickel, an elastic layer formed on the surface of substrate, made of an elastomer material (for example, silicone rubber) having excellent heat resistance and elastic property, and a release layer formed on the surface of the elastic layer, made of a synthetic resin material (for example, a fluorine resin such as PFA or PTFE) having excellent heat resistance and releasing property. Moreover, a fluorine resin may be added into polyimide of the substrate. This makes it possible to reduce a slide load with the heating member 50.

Figure 6:
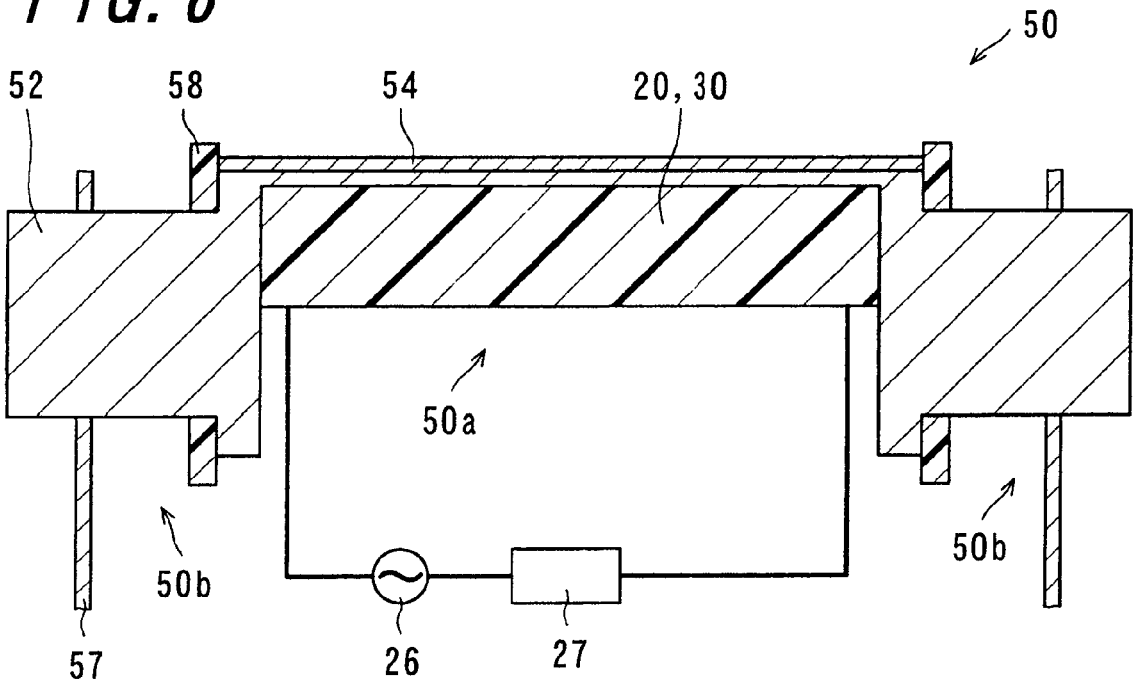
FIG. 6 is a view showing the structure of a heating member provided in the fixing device.

FIG. 6 is a view showing the structure of the heating member 50 provided in the fixing device 15. The heating member 50 is a member that is in contact with the fixing belt 54 to heat the fixing belt 54 to a predetermined temperature. The heating member 50 includes a substrate 52 and the planar heat generating element 20 or 30.

The substrate 52 has a hollow roll shape including a body portion 50*a* and a journal portion 50*b*, and the body portion 50*a* has a substantially semicircular cross section having a cut-out portion whose lower half part is cut off. The body portion 50*a* is a part which is brought into contact with the fixing belt 54. On the semi-circularly arcuate inner surface of the body portion 50*a* is fixedly disposed the foregoing planar heat generating element 20 or 30 embodying the invention, with its longitudinal edge aligned with an axial direction of the substrate 52. With such a configuration, the body portion 50*a* acts to transmit the heat generated in the planar heat generating element 20, 30 to the fixing belt 54. It is therefore necessary to constitute the substrate 52 by a material having a high thermal conductivity. As the material used for forming the substrate 52, a metal such as aluminum may be adopted.

Moreover, it is desirable to form a top coat layer on the body portion 50*a*, which is that part of the substrate 52 which is brought into contact with the fixing belt 54, for achieving a reduction in the force of friction with the fixing belt 54. As the material used for forming the top coat layer, at least one of a PTFE resin and a PFA resin may be adopted. By virtue of the top coat layer, the force of friction between the heating member 50 and the fixing belt 54 can be reduced. This makes it possible to protect the fixing belt 54 from abrasion and thereby impart high durability to the fixing belt 54. In addition, it is also possible to reduce the load placed on the fixing roller 15*a* and the pressure roller 15*b* for driving the fixing belt 54 and thereby impart high durability to the rollers 15*a* and 15*b*. This enables a low-power drive.

With the provision of the planar heat generating element 20, 30 embodying the invention, in the heating member 50, it never occurs that the resistance heat generator of the planar heat generating element 20, 30 suffers from localized peeling or fracture due to the passage of electric current, wherefore occurrence of localized excessive heat generation can be prevented therein. Accordingly, the heating member 50 enjoys a longer service life with the attainment of long-term reliability and safety.

The journal portion 50*b*, which is formed at each end of the body portion 50*a*, is secured to a side frame 57 of the fixing device 15 in order that the heating member 50 in itself will not turn under the force of friction with the fixing belt 54. In this way, since the heating member 50 in itself is mounted in an unturnable state, even if the planar heat generating element 20, 30 receives the supply of high electric current under a heat-generating condition, it is possible to attain a sufficiently high degree of safety.

Moreover, the journal portion 50*b* is formed with a meandering prevention collar 58 for preventing the fixing belt 54 from running windingly during its slidingly turning movement. The meandering prevention collar 58 is disposed in contact with the end of the fixing belt 54. As the meandering prevention collar 58, a collar made of polyphenylene sulfide (PPS) may be used. However, this does not suggest any limitation to the meandering prevention collar 58, and therefore any given collar component may be adopted so long as it is made turnable independently of the heating member 50. In this way, since the meandering prevention collar 58 is free to turn independently, even if the fixing belt 54 abuts against the meandering prevention collar 58, no load is placed thereon and thus no undesirable sliding motion occurs. This helps protect the fixing belt 54 from cracking, wherefore the durability of the fixing belt 54 can be maintained at a high level.

In the fixing device 15, the planar heat generating element 20, 30 extends in parallel with the axial direction of the fixing roller 15*a* so as to conform to the semi-circularly arcuate inner surface of the body portion 50*a*. At this time, it is preferable that the planar heat generating element 20, 30 is disposed with its insulating layer 24, 41 kept in contact with the body portion 50*a* of the substrate 52. In this case, it is possible to secure insulation between the resistance heat generator of the planar heat generating element 20, 30 and the substrate 52, thus imparting a higher degree of safety to the heating member 50.

Moreover, in the fixing device 15, as a temperature detecting section, a thermistor on the heat generating element side 53 is disposed on a circumferential surface of the fixing belt 54 and a thermistor on the pressure roller side 55 is disposed on a circumferential surface of the pressure roller 15*b*, so that respective surface temperatures are detected. In addition, based on temperature data detected by each of the thermistors 53 and 55, a control circuit (not shown) as a temperature control section controls fed power (electrification) to the planar heat generating element 51 and the heater lamp 56 so that the fixing belt 54 and the pressure roller 15*b* have the predetermined surface temperatures.

Figure 7:
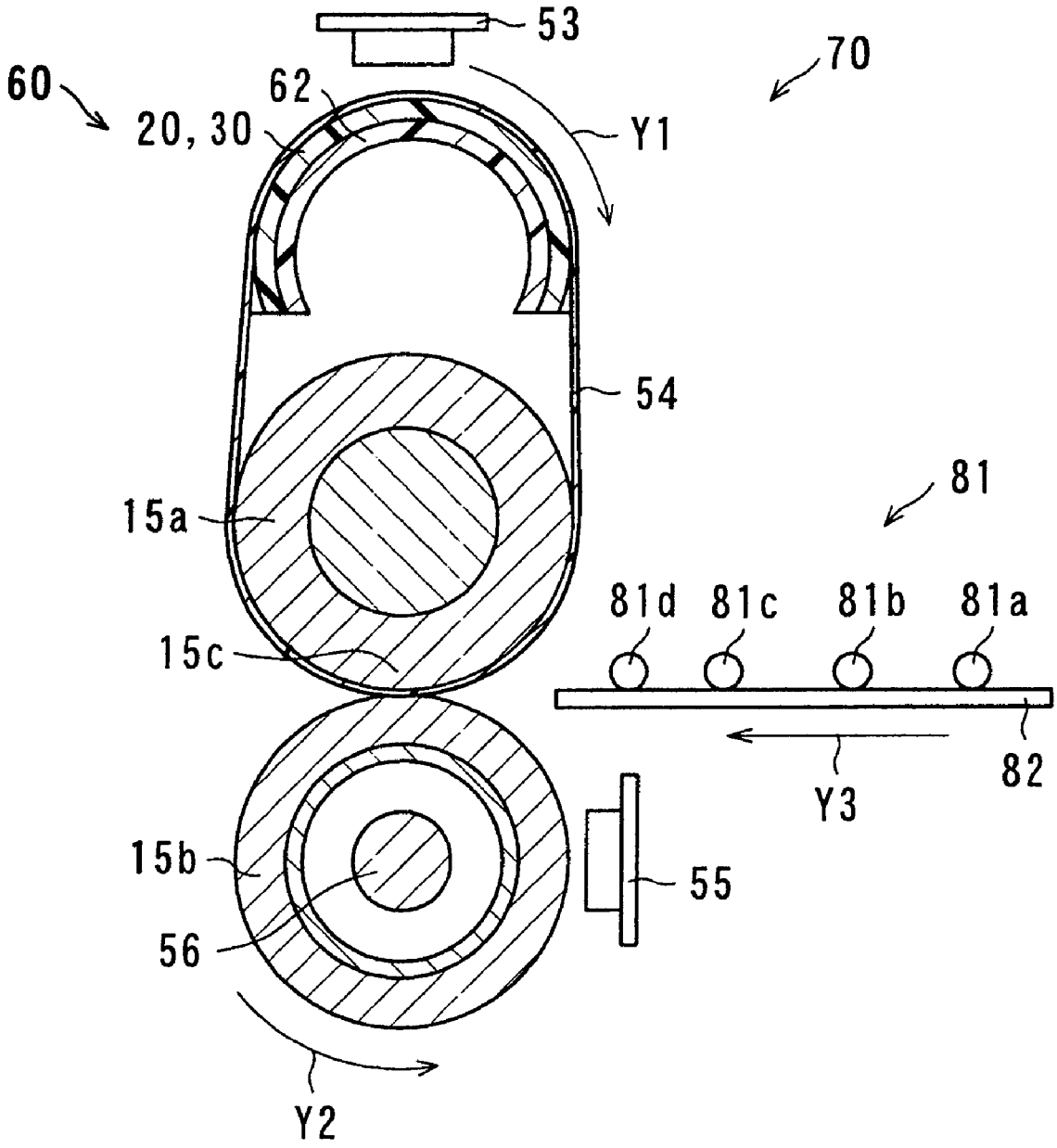
FIG. 7 is a view showing the structure of a fixing device in accordance with a fourth embodiment of the invention.

FIG. 7 is a view showing the structure of a fixing device 70 in accordance with a fourth embodiment of the invention. The fixing device 70 is analogous to the foregoing fixing device 15, and therefore its components that play the same or corresponding roles as in the fixing device 15 will be denoted by the same reference symbols, and overlapping descriptions will be omitted. In the fixing device 70, its heating member 60 differs from the heating member 50 of the fixing device 15 in the layer configuration of a body portion of a substrate 62.

In the fixing device 70, the planar heat generating element 20, 30 extends in parallel with the axial direction of the fixing roller 15*a* so as to conform to the semi-circularly arcuate outer surface of the body portion. That is, the planar heat generating element 20, 30 is brought into contact with the fixing belt 54. At this time, it is preferable that the planar heat generating element 20, 30 is formed on the outer surface of the substrate 62, with its coat layer acting as an outermost layer in the body portion of the heating member 60, which is brought into contact with the fixing belt 54. In this case, the force of friction between the heating member 60 and the fixing belt 54 can be reduced. This makes it possible to protect the fixing belt 54 from abrasion and thereby impart high durability to the fixing belt 54. In addition, it is also possible to reduce the load placed on the fixing roller 15*a* and the pressure roller 15*b* for driving the fixing belt 54 and thereby impart high durability to the rollers 15*a* and 15*b*. This enables a low-power drive.

Moreover, in the case of forming the planar heat generating element 20, 30 fixedly on the outer surface of the substrate 62, with its coat layer acting as an outermost layer in the body portion of the heating member 60, the insulating layer 24, 41 of the planar heat generating element 20, 30 acts as a layer which is brought into contact with the substrate 62. This makes it possible to secure insulation between the resistance heat generator of the planar heat generating element 20, 30 and the substrate 62, thus imparting a higher degree of safety to the heating member 60.

In the fixing device 70 thereby constructed, just as with the fixing device 15, the heating member 60 is provided with the planar heat generating element 20, 30 embodying the invention. Accordingly, it never occurs that the resistance heat generator of the planar heat generating element 20, 30 suffers from localized peeling or fracture due to the passage of electric current, wherefore occurrence of localized excessive heat generation can be prevented therein. As a result, the heating member 60 enjoys a longer service life with the attainment of long-term reliability and safety.

Figure 8:
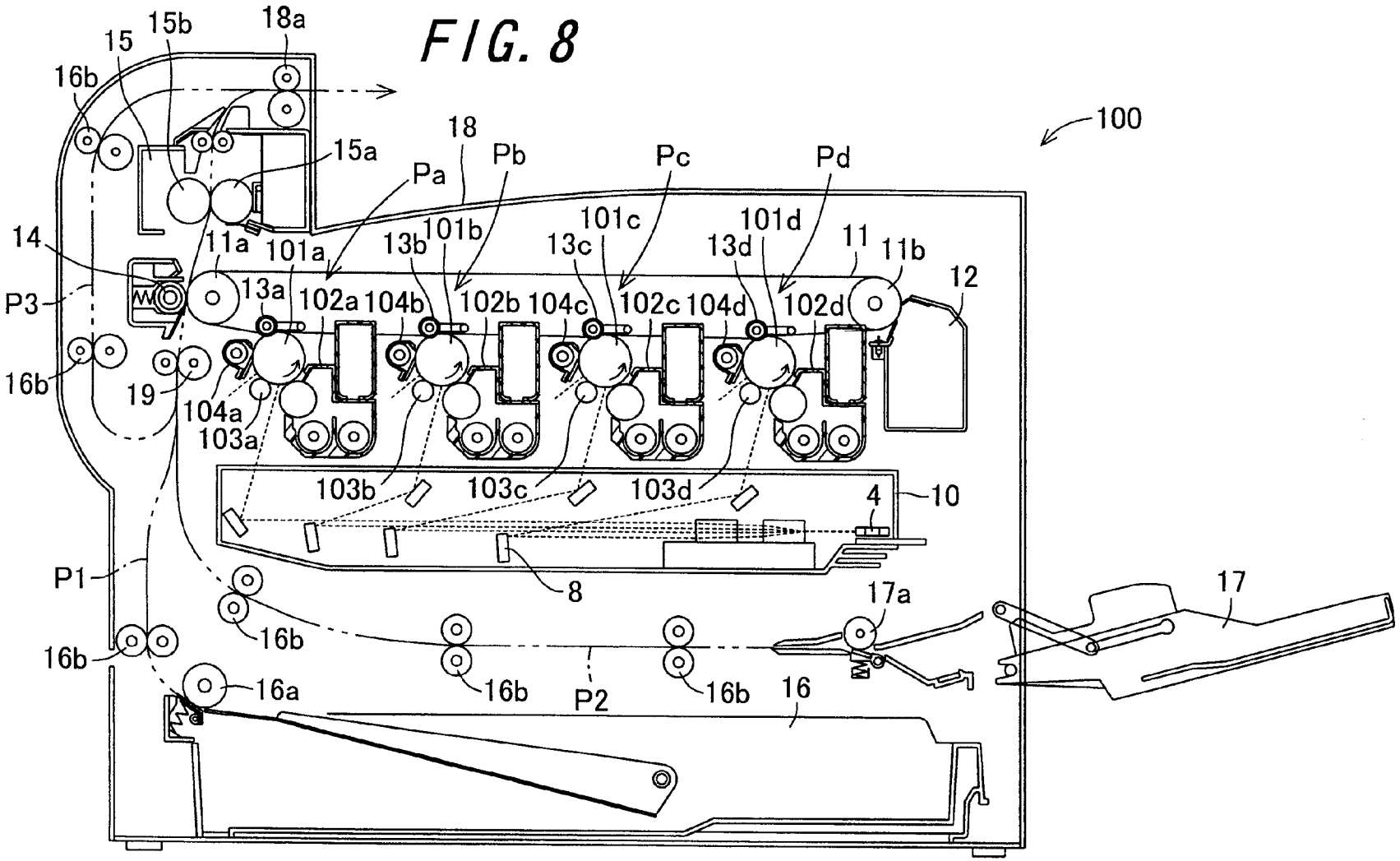
FIG. 8 is a view showing the structure of an image forming apparatus in accordance with a fifth embodiment of the invention.
Figure 9:
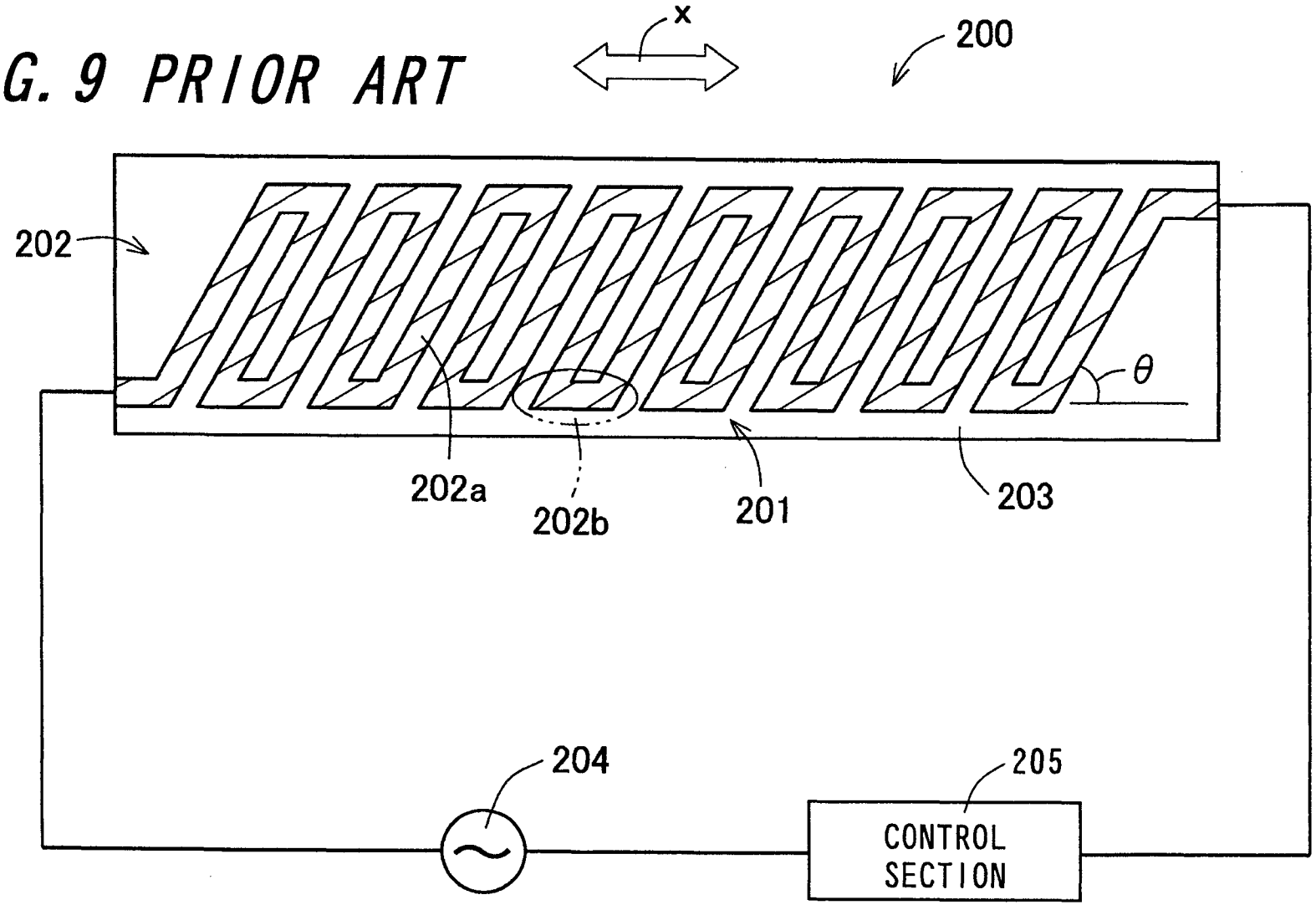
FIG. 9 PRIOR ART
FIG. 9 is a view showing the structure of a planar heat generating element provided in a fixing device according to the related art.

FIG. 8 is a view showing the structure of an image forming apparatus 100 in a fifth embodiment of the invention. The image forming apparatus 100 is an apparatus that forms a color or monochrome image on a recording paper sheet based on image data read from a document or on image data transmitted through a network and the like. The image forming apparatus 100 includes an exposure unit 10, photoreceptor drums 101 (101*a* to 101*d*), developing devices 102 (102*a* to 102*d*), charging rollers 103 (103*a* to 103*d*), cleaning units 104 (104*a* to 104*d*), an intermediate transfer belt 11, primary transfer rollers 13 (13*a* to 13*d*), a secondary transfer roller 14, a fixing device 15, paper conveyance paths P1, P2, and P3, a paper feeding cassette 16, a manual paper feeding tray 17, and a catch tray 18.

The image forming apparatus 100 performs image formation by using image data corresponding to each of the four colors of black (K), as well as cyan (C), magenta (M), and yellow (Y), which are the three primary subtractive colors obtained by separating colors of a color image, in image forming sections Pa to Pd corresponding to the respective colors. The respective image forming sections Pa to Pd are similar to one another in configuration, and for example, the image forming section Pa for black (K) is constituted by the photoreceptor drum 101*a*, the developing device 102*a*, the charging roller 103*a*, the primary transfer roller 13*a*, the cleaning unit 104*a*, and the like. The image forming sections Pa to Pd are arranged in alignment along a direction in which the intermediate transfer belt 11 moves (sub-scanning direction).

The charging rollers 103 are contact-type charging devices for charging surfaces of the photoreceptor drums 101 uniformly to a predetermined potential. Instead of the charging rollers 103, contact-type charging devices using a charging brush, or noncontact-type charging devices using a charging wire is also usable.

The exposure unit 10 includes a semiconductor laser (not shown), a polygon mirror 4, a first reflection mirror 7, a second reflection mirror 8, and the like, and irradiates each of the photoreceptor drums 101*a* to 101*d* with each light beam such as a laser beam modulated according to image data of the respective colors of black (K), cyan (C), magenta (M), and yellow (Y). Each of the photoreceptor drums 101*a* to 101*d* forms an electrostatic latent image corresponding to the image data of the respective colors of black (K), cyan (C), magenta (M), and yellow (Y).

The developing devices 102 supply toner as developer to the surfaces of the photoreceptor drums 101 on which the electrostatic latent images are formed, to develop the electrostatic latent images to a toner image. The respective developing devices 102*a* to 102*d* contain toner of the respective colors of black (K), cyan (C), magenta (M), and yellow (Y), and visualize the electrostatic latent images of the respective colors formed on the respective photoreceptor drums 101*a* to 101*d* into toner images of the respective colors. The cleaning units 104 remove and collect residual toner on the surfaces of the photoreceptor drums 101 after development and image transfer.

The intermediate transfer belt 11 provided above the photoreceptor drums 101 is supported around a driving roller 11*a* and a driven roller 11*b* with tension, and forms a loop-shaped moving path. An outer circumferential surface of the intermediate transfer belt 11 faces the photoreceptor drum 101*d*, the photoreceptor drum 101*c*, the photoreceptor drum 101*b* and the photoreceptor drum 101*a* in this order. The primary transfer rollers 13*a* to 13*d* are disposed at positions facing the respective photoreceptor drums 101*a* to 101*d* across the intermediate transfer belt 11. The respective positions at which the intermediate transfer belt 11 faces the photoreceptor drums 101*a* to 101*d* are primary transfer positions. In addition, the intermediate transfer belt 11 is formed of a film having thickness of 100 to 150 μm.

A primary transfer bias having the opposite polarity to the polarity of the toner is applied by constant voltage control to the primary transfer rollers 13*a* to 13*d* in order to transfer the toner images borne on the surfaces of the photoreceptor drums 101*a* to 101*d* onto the intermediate transfer belt 11. Thus, the toner images of the respective colors formed on the photoreceptor drums 101*a* to 101*d* are transferred and overlapped onto the outer circumferential surface of the intermediate transfer belt 11 sequentially to form a full-color toner image on the outer circumferential surface of the intermediate transfer belt 11.

However, when image data for only a part of the colors of yellow (Y), magenta (M), cyan (C) and black (B) is inputted, electrostatic latent images and toner images are formed at only a part of the photoreceptor drums 101 corresponding to the colors of the inputted image data among the four photoreceptor drums 101*a* to 101*d*. For example, during monochrome image formation, an electrostatic latent image and a toner image are formed only at the photoreceptor drum 101*a* corresponding to black color, and only a black toner image is transferred onto the outer circumferential surface of the intermediate transfer belt 11.

The respective primary transfer rollers 13*a* to 13*d* have a structure comprising a shaft having a diameter of 8 to 10 mm, made of a metal such as stainless steel and serving as a substrate, and a conductive elastic material (for example, EPDM or urethane foam) with which a surface of the shaft is coated, and uniformly apply a high voltage to the intermediate transfer belt 11 by the conductive elastic material.

The toner image transferred onto the outer circumferential surface of the intermediate transfer belt 11 at each of the primary transfer positions is conveyed to a secondary transfer position, which is a position facing the secondary transfer roller 14, by the rotation of the intermediate transfer belt 11. The secondary transfer roller 14 is brought into pressure-contact with, at a predetermined nip pressure, the outer circumferential surface of the intermediate transfer belt 11 whose inner circumferential surface is in contact with a circumferential surface of the driving roller 11*a* during image formation. While a recording paper sheet fed from the paper feeding cassette 16 or the manual paper feeding tray 17 passes between the secondary transfer roller 14 and the intermediate transfer belt 11, a high voltage with the opposite polarity to the charging polarity of the toner is applied to the secondary transfer roller 14. Thus, the toner image is transferred from the outer circumferential surface of the intermediate transfer belt 11 to the surface of the recording paper sheet.

Note that, of the toner adhered from the photoreceptor drums 101 to the intermediate transfer belt 11, toner that has not been transferred onto the recording paper sheet and remains on the intermediate transfer belt 11 is collected by a transfer cleaning unit 12 in order to prevent color mixture in the following process.

The recording paper sheet onto which the toner image has been transferred is guided to the above-described fixing device 15, 70 of the invention so as to pass through the fixing nip region formed between the fixing belt 54 that is supported around the fixing roller 15*a* and the heating member 50, 60 with tension, and the pressure roller 15*b* to be heated and pressed. Thus, the toner image is firmly fixed on the surface of the recording paper sheet. Since the fixing device 15, 70 performs fixation in the image forming apparatus 100, it is possible to cause the recording paper sheet to pass through the fixing nip region and to form an image in a state where peeling or fracture is prevented in the resistance heat generator due to localized excessive heat generation and high reliability and power saving are realized. The recording paper sheet on which the toner image has been fixed is discharged by paper discharge rollers 18*a* onto the catch tray 18.

Moreover, the image forming apparatus 100 is provided with the paper conveyance path P1 extending in the substantially vertical direction, for feeding a recording paper sheet contained in the paper feeding cassette 16 through a region between the secondary transfer roller 14 and the intermediate transfer belt 11, and by way of the fixing device 15, 70, to the catch tray 18. The paper conveyance path P1 is provided with a pickup roller 16*a* for picking up recording paper sheets in the paper feeding cassette 16 in the paper conveyance path P1 sheet by sheet, conveying rollers 16*b* for conveying the fed recording paper sheet upward, registration rollers 19 for guiding the conveyed recording paper sheet between the secondary transfer roller 14 and the intermediate transfer belt 11 at a predetermined timing, and the paper discharge rollers 18*a* for discharging the recording paper sheet onto the catch tray 18.

Moreover, inside the image forming apparatus 100, the paper conveyance path P2 on which a pickup roller 17*a* and conveying rollers 16*b* are disposed is formed between the manual paper feeding tray 17 and the registration rollers 19. In addition, the paper conveyance path P3 is formed between the paper discharge rollers 18*a* and the upstream side of the registration rollers 19 in the paper conveyance path P1.

The paper discharge rollers 18*a* freely rotate in both forward and reverse directions, and are driven in the forward direction to discharge a recording paper sheet onto the catch tray 18 during single-sided image formation in which images are formed on one side of the recording paper sheets, and during second side image formation of double-sided image formation in which images are formed on both sides of the recording paper sheet. On the other hand, during first side image formation of double-sided image formation, the paper discharge rollers 18*a* are driven in the forward direction until a tail edge of the sheet passes through the fixing device 15, 70, and are then driven in the reverse direction to bring the recording paper sheet into the paper conveyance path P3 in a state where the tail edge of the recording paper sheet is held. Thus, the recording paper sheet on which an image has been formed only on one side during double-sided image formation is brought into the paper conveyance path P1 in a state where the recording paper sheet is turned over and upside down.

The registration rollers 19 bring the recording paper sheet that has been fed from the paper feeding cassette 16 or the manual paper feeding tray 17, or has been conveyed through the paper conveyance path P3 between the secondary transfer roller 14 and the intermediate transfer belt 11 at a timing synchronized with the rotation of the intermediate transfer belt 11. Thus, the rotation of the registration rollers 19 is stopped when the operation of the photoreceptor drums 101 or the intermediate transfer belt 11 is started, and the movement of the recording paper sheet that has been fed or conveyed prior to the rotation of the intermediate transfer belt 11 is stopped in the paper conveyance path P1 in a state where a leading edge thereof abuts against the registration rollers 19. Then, the rotation of the registration rollers 19 is started at a timing when the leading edge of the recording paper sheet faces a leading edge of a toner image formed on the intermediate transfer belt 11 at a position where the secondary transfer roller 14 is brought into pressure-contact with the intermediate transfer belt 11.

Note that, during full-color image formation in which image formation is performed by all of the image forming sections Pa to Pd, all of the primary transfer rollers 13*a* to 13*d* bring the intermediate transfer belt 11 into pressure-contact with the photoreceptor drums 101*a* to 101*d*. On the other hand, during monochrome image formation in which image formation is performed only by the image forming section Pa, only the primary transfer roller 13*a* brings the intermediate transfer belt 11 into pressure-contact with the photoreceptor drum 101*a*.

EXAMPLE

Although the invention will hereinafter be described in detail with reference to examples, the invention will not be limited to these examples.

Example 1

A fixing device used in Example 1 was the above-described fixing device 70. The fixing device 70 was installed in a copying machine (product name: MX-7000N manufactured by SHARP CORPORATION). The detailed conditions set for Example 1 are as follows.

<Fixing Roller>

Used was a fixing roller that has a diameter of 30 mm, in which stainless steel having a diameter of 15 mm was used for a core metal and silicone sponge rubber having thickness of 7.5 mm was used for an elastic layer.

<Pressure Roller>

Used was a pressure roller that has a diameter of 30 mm and is made of silicone solid rubber, in which PFA tube having thickness of 30 μm was used for a release layer and a heater lamp having a rated power of 400 W is disposed inside.

<Fixing Belt>

Used was a fixing belt in which polyimide having thickness of 70 μm was used for a belt substrate, silicone rubber having thickness of 150 μm was used for an elastic layer, and a PTFE coat having thickness of 30 μm was used for a release layer.

<Meandering Prevention Collar>

A polyphenylene sulfide (PPS) collar having an inner diameter of 20 mm, a diameter of 32 mm, and a width of 7 mm was disposed so as to be in contact with an end of the fixing belt.

<Heating Member>

Substrate: Used was an aluminum pipe having thickness of 1 mm in which a body section had a diameter of 28 mm and a journal section had a diameter of 20 mm and the belt slide which was a circular shape with half thereof cut.

Planar heat generating element: the planar heat generating element employed in Example 1 is the foregoing planar heat generating element 20. In the planar heat generating element, the length of its longitudinal edge extending in alignment with an axial direction of the fixing roller was set to 330 mm. On the circularly arcuate outer surface of the substrate was formed an alumina-made insulating layer by means of plasma spray coating. Then, with the placement of a masking material in conformity with the shape of the heat generating pattern 21 of the planar heat generating element 20, on the surface of the insulating layer, a resistance heat generator was formed; that is, linear portions were formed with use of a material composed predominantly of nickel chromium (volume resistivity: $107.3\times10^{-8}$ Ωcm) and low-volume resistivity portions were formed with use of copper (volume resistivity: $1.55\times10^{-8}$ Ωcm) by means of plasma spray coating. Following the completion of pattern formation, the masking material was removed, and the surface of the structure was coated with a 20 μm-thick PTFE layer. Lastly, a lead wire was connected to the power feeding terminal portions. In this construction, the electrical resistance between the power feeding terminal portions was set to 10Ω.

Note that the resistance heat generator is 15 mm in width. In order to determine the interval between the adjacent linear portions and the inclination angle θ of the linear portions, firstly the width, length, and film thickness of the linear portion to be placed have been estimated on the basis of the amount of power in the heat generating region, the applied voltage, and the volume resistivity of the resistance heat generator for use. Then, the distribution of the surface temperatures of the fixing belt in the image region was obtained by actual measurement using a radiation thermometer, and the fixability of a fixed image was checked. In consideration of the above, the spaced intervals and the inclination angle as to the linear portions have been determined with some adjustment. Note that the inclination angle θ of the linear portion was set to 70°.

<Thermistor>

As a thermistor on the heat generating element side, a thermistor of a noncontact type was used, and as a thermistor on the pressure roller side, a thermistor of a contact type was used.

<Fixing Condition>

Length of fixing nip region: 7 mm (length in a recording paper sheet conveyance direction of the fixing nip region)

Fixing speed: 220 mm/sec

Length of heating nip region: 44 mm (length in a recording paper sheet conveyance direction where the fixing belt and the heating member were in contact with each other)

Width of heating nip region: 330 m (length corresponding to the axial direction of the fixing roller)

A cycling test has been conducted on Example 1 as follows. Firstly a voltage of 100 V is applied from the power source to the planar heat generating element of Example 1 via the control section. Upon the surface temperature of the planar heat generating element being raised to 200° C., the passage of electric current is discontinued and a cool-down process is effected to lower the elevated temperature to a room temperature level. Even after a run of 10,000 cycles, there was no sign of peeling or fracture in the resistance heat generator. That is, it has been found that occurrence of localized excessive heat generation can be prevented successfully. In addition, there was no problem with the electric current flowability (electrical resistance and power) in the heat generating pattern of the planar heat generating element.

Moreover, the heating member is designed to have roller-shaped end portions, with each of which is fitted the meandering prevention collar. Therefore, the fixing belt can be restrained from winding motion. In this construction, the alumina-made substrate in itself is mounted in an unturnable state, but the collar is made of PPS and is designed to be turnable independently. Although the fixing belt abutted at its end against the meandering prevention collar, since the meandering prevention collar is able to turn in synchronization with the turning of the fixing belt without sliding motion, the end portion of the fixing belt was free of application of a load and thus protected from cracking. Moreover, with a lesser degree of abrasion, the fixing belt has proved to have a life at the level of 200K copies. Further, even under the condition where a high electric current (10 A) is passing through the planar heat generating element of the heating member, there was no sign of peeling or fracture in the resistance heat generator. That is, it has been found that occurrence of localized excessive heat generation can be prevented and a sufficiently high degree of safety can be attained.

As another advantage, since a light coating of PTFE resin was applied to the surface of the planar heat generating element, the force of friction between the planar heat generating element and the fixing belt could be reduced. This allowed the fixing belt to slide smoothly. Moreover, heat could be transferred to the fixing belt with high efficiency, and also the fixing belt could be restrained from winding motion. Further, it was possible to ensure a 200K-level belt life.

Note that the heat emanating from the planar heat generating element is transmitted via the PTFE layer to the fixing belt. The time required for the surface temperature of the belt on the fixing roller to reach 190° C. was 29.5 seconds and there was no problem with the time spent in a warming-up process. Moreover, the average power density of the planar heat generating element was found to be 6.9 W/cm$^2$. Further, in the end portion of the planar heat generating element, the resistance heat generator portions are arranged densely. Therefore, in the planar heat generating element, its end portion is higher in power density than its midportion, whereby making it possible to suppress temperature irregularity ascribable to heat dissipation from the end portion, as well as to achieve uniformity in fixability. As a result, high-quality images were obtained.

Accordingly, the invention succeeded in providing a copying machine having a fixing device that attains long-term reliability and safety and has a long-life heating member and that has nevertheless an energy-saving nature.

Example 2

In Example 2, as the heat generating pattern of the planar heat generating element for use in the heating member, instead of the heat generating pattern 21 of the planar heat generating element 20, the heat generating patterns 31, 34, and 37 of the planar heat generating element 30 were employed. Otherwise, Example 2 has the same structure as that of Example 1.

Note that the resistance heat generator is 6.6 mm in width. In order to determine the interval between the adjacent linear portions and the inclination angle θ of the linear portion, firstly the width, length, and film thickness of the linear portion to be placed have been estimated on the basis of the amount of power in the heat generating region, the applied voltage, and the volume resistivity of the resistance heat generator for use. Then, the distribution of the surface temperatures of the fixing belt in the image region was obtained by actual measurement using a radiation thermometer, and the fixability of a fixed image was checked. In consideration of the above, the spaced intervals and the inclination angle as to the linear portions have been determined with some adjustment. Note that the inclination angle θ of the linear portion was set to 70°.

In the cycling test conducted on Example 2, even after a run of 10,000 cycles, there was no sign of peeling or fracture in the resistance heat generator. That is, it has been found that occurrence of localized excessive heat generation can be prevented successfully. Moreover, there was no problem with the electric current flowability in the heat generating pattern of the planar heat generating element (no problem arose with electrical resistance and power). In addition, just as with Example 1, the fixing belt has proved to have a life at the level of 200K copies.

Note that, in Example 2, the planar heat generating element was given a pattern configuration designed such that the centrally-located heat generating pattern exhibits 680 watts of power, whereas the heat generating pattern located at each of the end portions exhibits 310 watts of power. Then, at the time of feeding a small-sized recording paper sheet, electric current was passed through the centrally-located heat generating pattern only. In this way, being controlled as to heat generation, the end portions of the planar heat generating element were not subjected to abnormal temperature rise. Moreover, there was no problem with the time spent in a warming-up process, and thus an energy-saving fixing device could be constructed.

Comparative Example 1

In Comparative Example 1, as the heat generating pattern of the planar heat generating element for use in the heating member, instead of the heat generating pattern 21 of the planar heat generating element 20, the heat generating pattern 201 of the planar heat generating element 200 devoid of the low-volume resistivity portions was employed. Otherwise, Comparative Example 1 has the same structure as that of Example 1. Note that, in Comparative Example 1, the resistance heat generator was made of a material composed predominantly of nickel chromium.

A cycling test has also been conducted on Comparative Example 1 as follows. Upon the surface temperature of the planar heat generating element being raised to 200° C., the passage of electric current is discontinued and a cool-down process is effected to lower the elevated temperature to a room temperature level. However, over a course of 10th cycle, electric current flowed intensively through the bend portion of the planar heat generating element interiorly thereof, with the result that the resistance heat generator suffered from peeling and ensuing fracture and has thus come to be incapable of receiving passage of electric current as a whole.

Comparative Example 2

Comparative Example 2 has been constructed as follows. Firstly on an insulating layer made of a 50 μm-thick polyimide film is created a resistance heat generator by performing etching on a thin leaf of stainless in conformity with the shape of the heat generating pattern 201 of the planar heat generating element 200, so that a film heater can be obtained. The film heater is bonded onto the circularly arcuate outer surface of the substrate with use of heat-resistant epoxy resin acting as an adhesive. Then, a coating of PFA tube is applied thereon. Otherwise, Comparative Example 2 has the same structure as that of Example 1.

A cycling test has also been conducted on Comparative Example 2 as follows. Upon the surface temperature of the planar heat generating element being raised to 200° C., the passage of electric current is discontinued and a cool-down process is effected to lower the elevated temperature to a room temperature level. However, over a course of 2nd cycle, electric current flowed intensively through the bend portion of the planar heat generating element interiorly thereof, which caused abnormal overheating. As a result, both of the insulating layer and the resistance heat generator have been peeled off from the substrate, overheating has been aggravated due to impossibility of heat transmission, and eventually a smoke came out of the planar heat generating element. At that point of time the test has come to an end.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A planar heat generating element for use in a fixing device for fixing a toner image borne on a recording medium onto the recording medium under application of heat and pressure, the planar heat generating element comprising:

an insulating layer;

a resistance heat generator formed on one surface in a thickness direction of the insulating layer, for generating heat upon a passage of electric current therethrough, the resistance heat generator constituting a plane of certain configuration as a whole and forming a heat generating pattern, the resistance heat generator comprising:

a plurality of linear portions formed on the one surface of the insulating layer so as to extend transversely with respect to a longitudinal of the insulating layer, the plurality of linear portions being arranged side by side substantially in parallel with one another; and a low-volume resistivity portion formed on the one surface of the insulating layer so as to extend in the longitudinal direction of the insulating layer, for connecting adjacent linear portions at their extending direction-wise ends to form a single line composed of the adjacent linear portions and the low-volume resistivity portion, the low-volume resistivity portion being made of a material which is lower in volume resistivity than a material for forming the linear portion, wherein the heat generating pattern is formed so as to be divided into plural pieces in the longitudinal direction of the insulating layer, and wherein, in two pieces among the plural pieces, the two pieces being each located at longitudinal end portions of the planar heat generating element, intervals among the plurality of linear portions adjacent to one another are set so as to become smaller from the center of the planar heat generating element toward each end thereof.

2. The planar heat generating element of claim 1, wherein a region in which the low-volume resistivity portion is formed includes a corner where the resistance heat generator bends.

3. The planar heat generating element of claim 1, wherein the plural pieces of heat generating pattern can be subjected to the passage of electric current independently of each other.

4. The planar heat generating element of claim 1, wherein an extending direction of the plurality of linear portions is inclined at a predetermined angle with respect to a longitudinal direction of the planar heat generating element.

5. The planar heat generating element of claim 1, wherein the material used for forming the low-volume resistivity portion is selected from among zinc, gold, copper, and silver.

6. A fixing device comprising:

a fixing member;

a heating member;

an endless fixing belt supported around the fixing member and the heating member with tension; and a pressure member disposed face to face with the fixing member, with the fixing belt interposed therebetween, the heating member heating the fixing belt in contact therewith, the fixing belt and the pressure member constituting a fixing nip region where a toner image borne on a recording medium is fixed into place under application of heat and pressure, the heating member having a heating portion for heating the fixing belt in contact therewith, the heating portion being formed with the planar heat generating element of claim 1 extending in a longitudinal direction of the fixing member.

7. The fixing device of claim 6, wherein the heating portion of the heating member has a substrate made of a material with a high thermal conductivity, and the planar heat generating element formed on one surface of the substrate, and the heating portion has a coat layer formed on a surface coming into contact with the fixing belt to allow a reduction in the force of friction between the heating member and the fixing belt.

8. The fixing device of claim 7, wherein the coat layer is formed of at least one of a PTFE resin and a PFA resin each of which contains fluorine.

9. An image forming apparatus comprising the fixing device of claim 6.

* * * * *